US009101822B2

(12) United States Patent
Liu

(10) Patent No.: US 9,101,822 B2
(45) Date of Patent: Aug. 11, 2015

(54) MAGIC CUBE STRUCTURE

(71) Applicant: Cheng Wei Liu, Taichung (TW)

(72) Inventor: Cheng Wei Liu, Taichung (TW)

( * ) Notice: Subject to any disclaimer, the term of this patent is extended or adjusted under 35 U.S.C. 154(b) by 0 days.

(21) Appl. No.: 14/483,276

(22) Filed: Sep. 11, 2014

(65) Prior Publication Data

US 2015/0076766 A1 Mar. 19, 2015

(30) Foreign Application Priority Data

Sep. 16, 2013 (TW) ..... 102133481 A

(51) Int. Cl.
*A63F 9/08* (2006.01)

(52) U.S. Cl.
CPC ..... *A63F 9/0826* (2013.01)

(58) Field of Classification Search
CPC ... A63F 9/0826; A63F 9/0834; A63F 9/0838; A63F 9/0842
See application file for complete search history.

(56) References Cited

U.S. PATENT DOCUMENTS

| | | | | | |
|---|---|---|---|---|---|
| 4,600,199 | A * | 7/1986 | Krell | 273/153 S |
| 5,271,688 | A * | 12/1993 | Chang | 273/153 S |
| 5,826,871 | A * | 10/1998 | Li | 273/153 S |
| 5,992,850 | A * | 11/1999 | Li | 273/153 S |
| 6,129,356 | A * | 10/2000 | Li | 273/153 S |
| 7,600,756 | B2 * | 10/2009 | Verdes | 273/153 S |
| 2007/0262522 | A1 * | 11/2007 | Lu | 273/153 S |
| 2008/0230988 | A1 * | 9/2008 | Paquette | 273/153 R |
| 2009/0127783 | A1 * | 5/2009 | Paquette | 273/153 S |
| 2012/0248696 | A1 * | 10/2012 | Wu | 273/153 S |
| 2014/0265116 | A1 * | 9/2014 | Christianson | 273/153 S |

* cited by examiner

*Primary Examiner* — Steven Wong
(74) *Attorney, Agent, or Firm* — Rosenberg, Klein & Lee

(57) ABSTRACT

A magic cube structure includes a central core, a plurality of central blocks, a plurality of resettling devices, a plurality of elastomers, a plurality of side blocks and a plurality of corner blocks. Whereby, when one central block is rotated relative to the central core by an outer force, one central block is pressed by the corresponding resettling device and is axially moved away therefrom. Simultaneously, the recovery force of the corresponding elastomer is increased, so that a torque imposed on the central block is created; when the rotation operation is completed, the torque makes the central block fitly abutted against the corresponding resettling device. As a result, the recovery force returns to former state.

7 Claims, 17 Drawing Sheets

MAGIC CUBE STRUCTURE

BACKGROUND OF THE INVENTION

1. Field of the Invention

The present invention relates to a magic cube, and more particularly to a magic cube structure, in which if the user unexpectedly rotates the central block a little degree, the negative torque would rotate the central block back to the original position, so that a recovery of the magic cube structure is smooth.

2. Description of the Prior Art

For one conventional magic cube structure, a central core usually has an elastomer so that when the unexpected rotation degree is just a little, the next step rotation would correct it. Clearly, when the directions of one rotation and the next rotation are the same, the next rotation would correct the unexpected rotation occurring therebefore. For example, one side of the conventional magic cube structure is rotated ten degrees clockwise, and then the adjacent one is rotated ninety degrees clockwise; as a result, the ten degrees would be corrected.

For another conventional magic cube structure, a control block has an inclined face, so that when the unexpected rotation degree is just a little, the next step rotation would correct it. Clearly, when the directions of one rotation and the next rotation are opposite to each other, the next rotation would correct the unexpected rotation occurring therebefore. For example, one side of the conventional magic cube structure is rotated ten degrees clockwise, and then the adjacent one is rotated ninety degrees counterclockwise; as a result, the ten degrees would be corrected.

Although the conventional magic cube structures could overcome the unexpected rotation, the operation rotation would not be smooth. Therefore, the user would rotate unsmoothly and slowly.

In theory, the resistance to the operation rotation would be a constant value no matter what position the central block is, so that there should not be a tendency to unexpectedly move the central block. However, there would be lots of tolerance during manufacturing, so that the resistance to the operation rotation would not be a constant value at some certain positions and the central block would be unexpectedly moved.

The present invention is, therefore, arisen to obviate or at least mitigate the above mentioned disadvantages.

SUMMARY OF THE INVENTION

An object of the present invention is to provide an improved magic cube structure, in which if the user unexpectedly rotates the central block a little degree, the negative torque would rotate the central block back to the original position. Therefore, the user would not worry about the unexpected rotation.

To achieve the above and other objects, a magic cube structure comprises a central core, a plurality of central blocks, a plurality of resettling devices, a plurality of elastomers, a plurality of side blocks and a plurality of corner blocks, an assembling member assembling each resettling device on the central core, each resettling device connecting each corresponding central block and the central core, a limiting structure for making each resettling device not able to rotate relative to the central core, each elastomer pushing each corresponding resettling device toward the central core, wherein, each resettling device has a first uneven surface, the first uneven surface abutting against each corresponding central block, when each elastomer pushes each corresponding resettling device toward the central core, each central block having a second uneven surface, the second uneven surface abutted against the first uneven surface of each corresponding resettling device, the second uneven surface and the first uneven surface fitly abutted against each other, via a recovery force of each corresponding elastomer. Whereby, when one central block is rotated relative to the central core by an outer force, the second uneven surface is pressed by the first uneven surface of the corresponding resettling device and is axially moved away therefrom; simultaneously, the recovery force of the corresponding elastomer is increased, so that a torque imposed on the central block is created; when the rotation operation is completed, the torque makes the second uneven surface fitly abutted against the corresponding first uneven surface once again; as a result, the recovery force returns to former state.

Wherein, the second uneven surface and the first uneven surface are both undulate; when the second uneven surface and the first uneven surface are fitly abutted against each other, there is no gap between the second uneven surface and the first uneven surface.

Wherein, the second uneven surface and the first uneven surface are both undulate; when the second uneven surface and the first uneven surface are abutted against each other, an abutting state is not fitly and a gap is defined therebetween.

Wherein, the central core is three-dimensional cross-shaped and has a plurality of extruded portions; each extruded portion has a positioning hole axially formed at a tip end thereof; each resettling device has an insert rod inserted into the positioning hole at a tip portion thereof; the limiting structure for making each resettling device not able to rotate relative to the central core is that the positioning hole is not completely circular.

Wherein, each central block has a through opening; the second uneven surface is abutted against the first uneven surface of each corresponding resettling device in the through opening; a cover is assembled on each central block so as to cover the through opening.

Wherein, the assembling member is illustrated as one selected form a group consisting of a screw, a rivet and a nut.

Wherein, each elastomer is illustrated as a spring which is mounted around the assembling member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
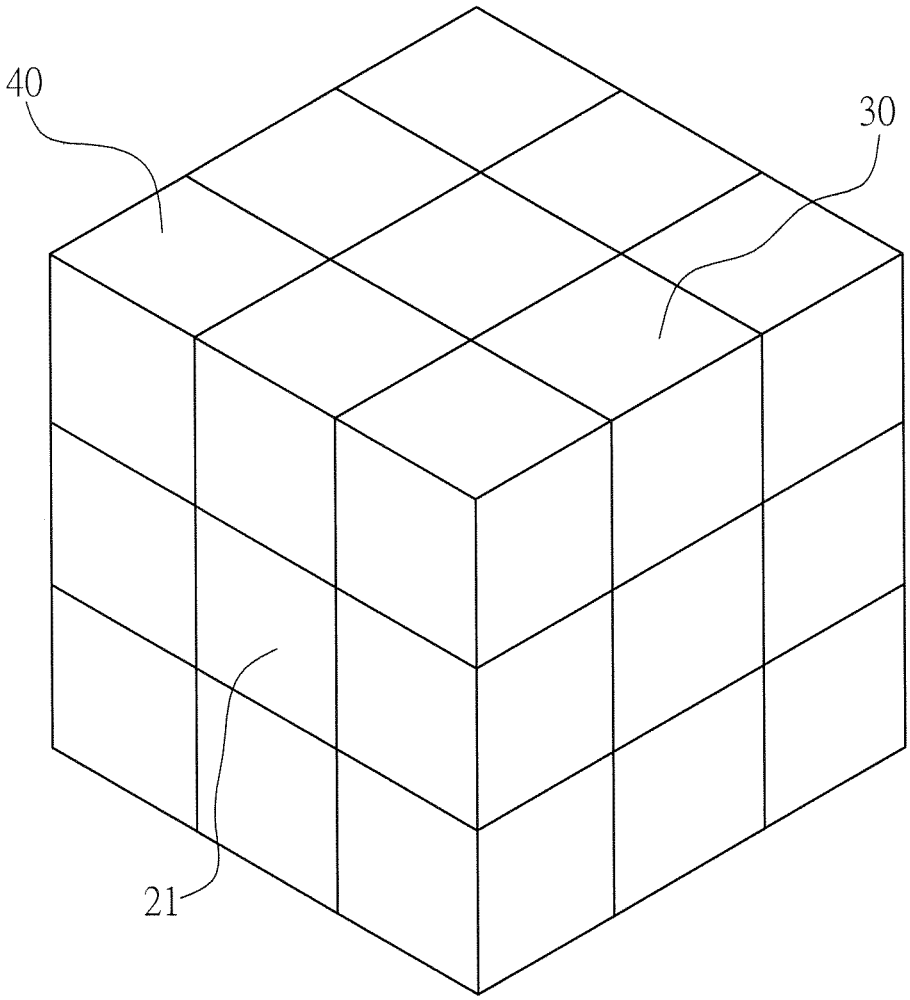
FIG. 1 is a perspective view of a first embodiment of the present invention.
Figure 2:
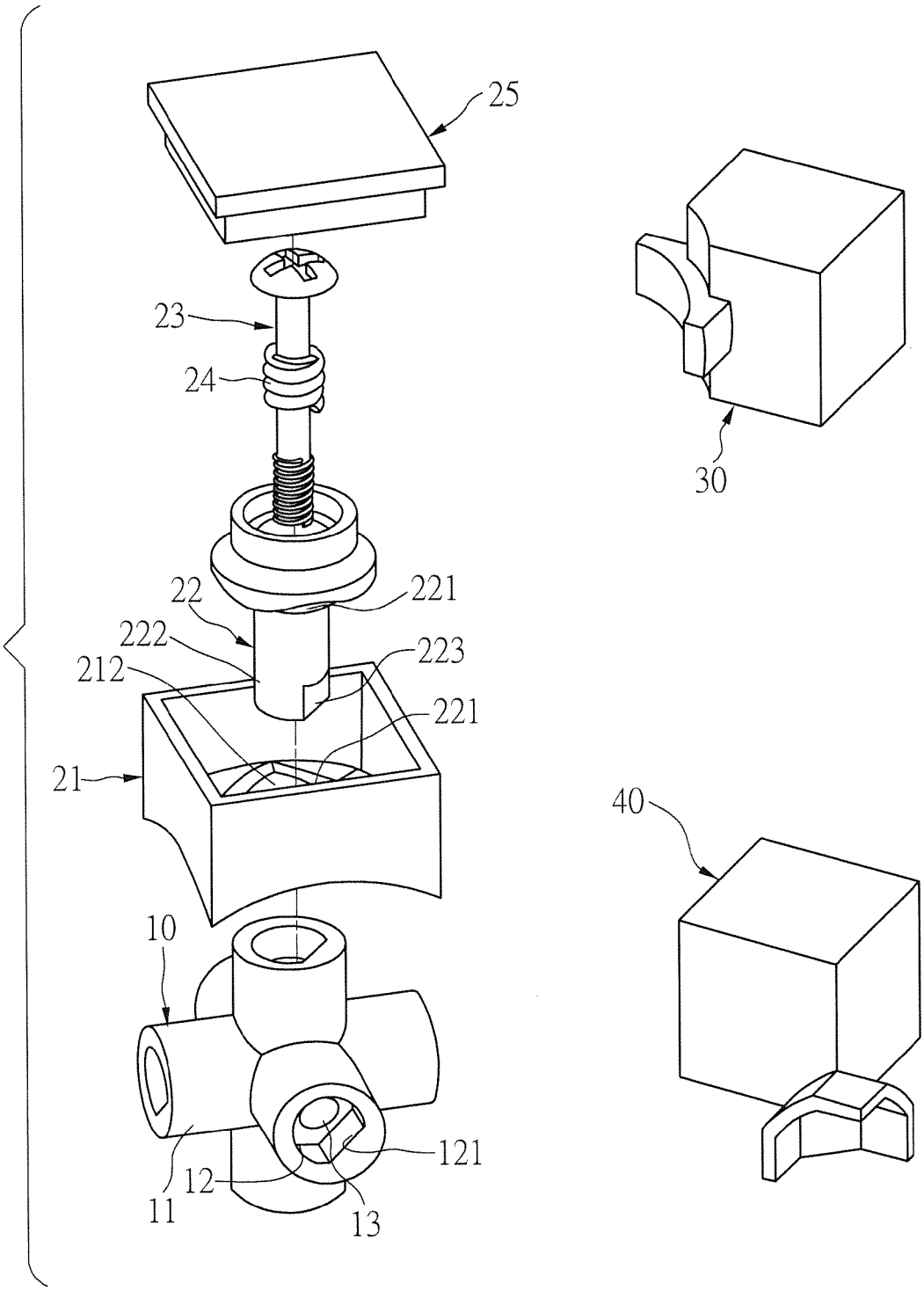
FIG. 2 is an explored view of the first embodiment for showing certain components.
Figure 3:
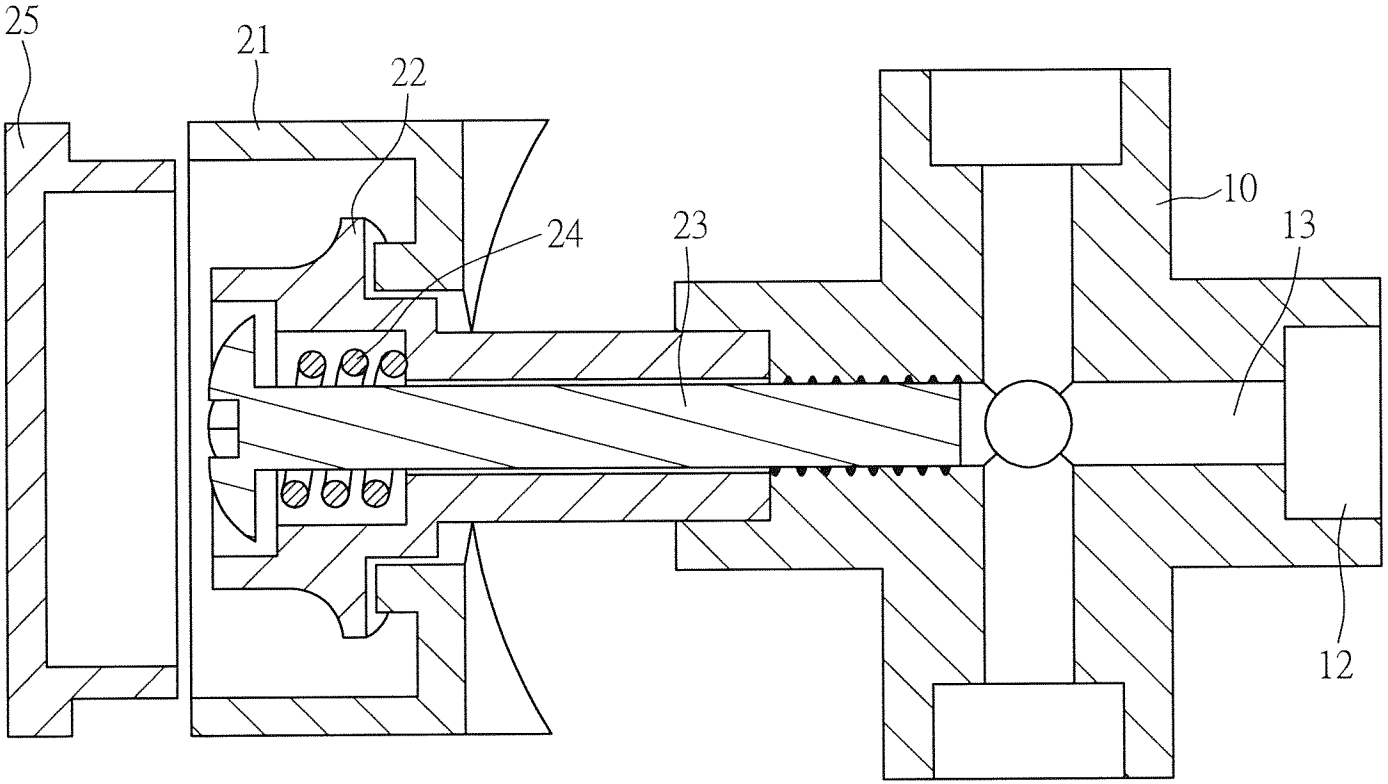
FIG. 3 is a cross-sectional view of the first embodiment for showing an inner structure.

Referring to FIGS. 1-3, a first embodiment in accordance with a magic cube structure of the present invention is described as follows. The magic cube structure which is polyhedron-shaped comprises a central core 10, a plurality of central blocks 21, a plurality of resettling devices 22, a plurality of elastomers 24, a plurality of side blocks 30 and a plurality of corner blocks 40. An assembling member 23 assembles each resettling device 22 on the central core 10. Each resettling device 22 connects each corresponding central block 21 and the central core 10. In this embodiment, the assembling member 23 is illustrated as a screw. In another embodiment, the assembling member 23 might be illustrated as a rivet or a nut. The magic cube structure has limiting structure for making each resettling device 22 not able to rotate relative to the central core 10. Each elastomer 24 pushes each corresponding resettling device 22 toward the central core 10. In this embodiment, each elastomer 24 is illustrated as a spring.

In this embodiment, the magic cube structure is illustrated as a Rubik's Cube. The magic cube structure has one central core 10, six central blocks 21, six resettling devices 22, six assembling members 23, six elastomers 24, twelve side blocks 30 and eight corner blocks 40.

In this embodiment, each resettling device 22 has a first uneven surface 221. When each elastomer 24 pushes each corresponding resettling device 22 toward the central core 10, the first uneven surface 221 abuts against each corresponding central block 21. Each central block 21 has a second uneven surface 211. The second uneven surface 211 is abutted against the first uneven surface 221 of each corresponding resettling device 22. The second uneven surface 211 and the first uneven surface 221 are both undulate. The second uneven surface 211 and the first uneven surface 221 are fitly abutted against each other, via a recovery force of each corresponding elastomer 24.

Under this arrangement, when one central block 21 is rotated relative to the central core 10 by an outer force, the second uneven surface 211 is pressed by the first uneven surface 221 of the corresponding resettling device 22 and is axially moved away therefrom. Simultaneously, the recovery force of the corresponding elastomer 24 is increased, so that a torque imposed on the central block 21 is created. When the rotation operation is completed, the torque makes the second uneven surface 211 fitly abutted against the corresponding first uneven surface 221 once again. As a result, the recovery force returns to former state.

Figure 4:
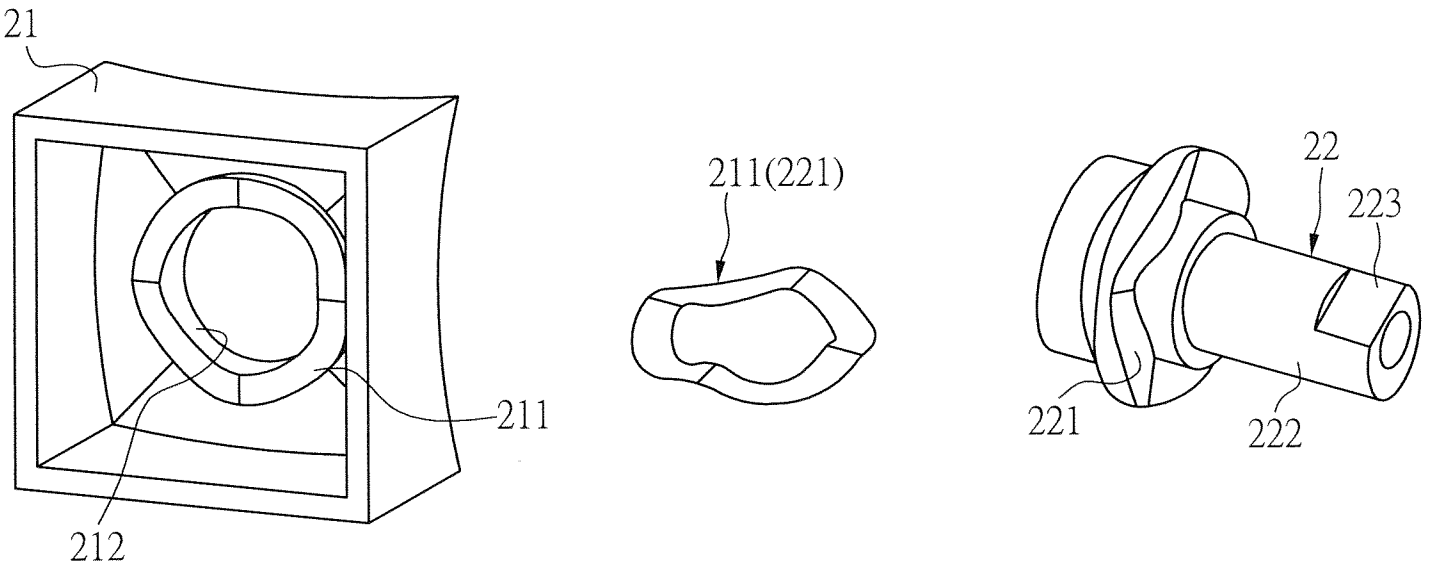
FIG. 4 is a perspective view of the first embodiment for showing the central block and the resettling device.
Figure 5:
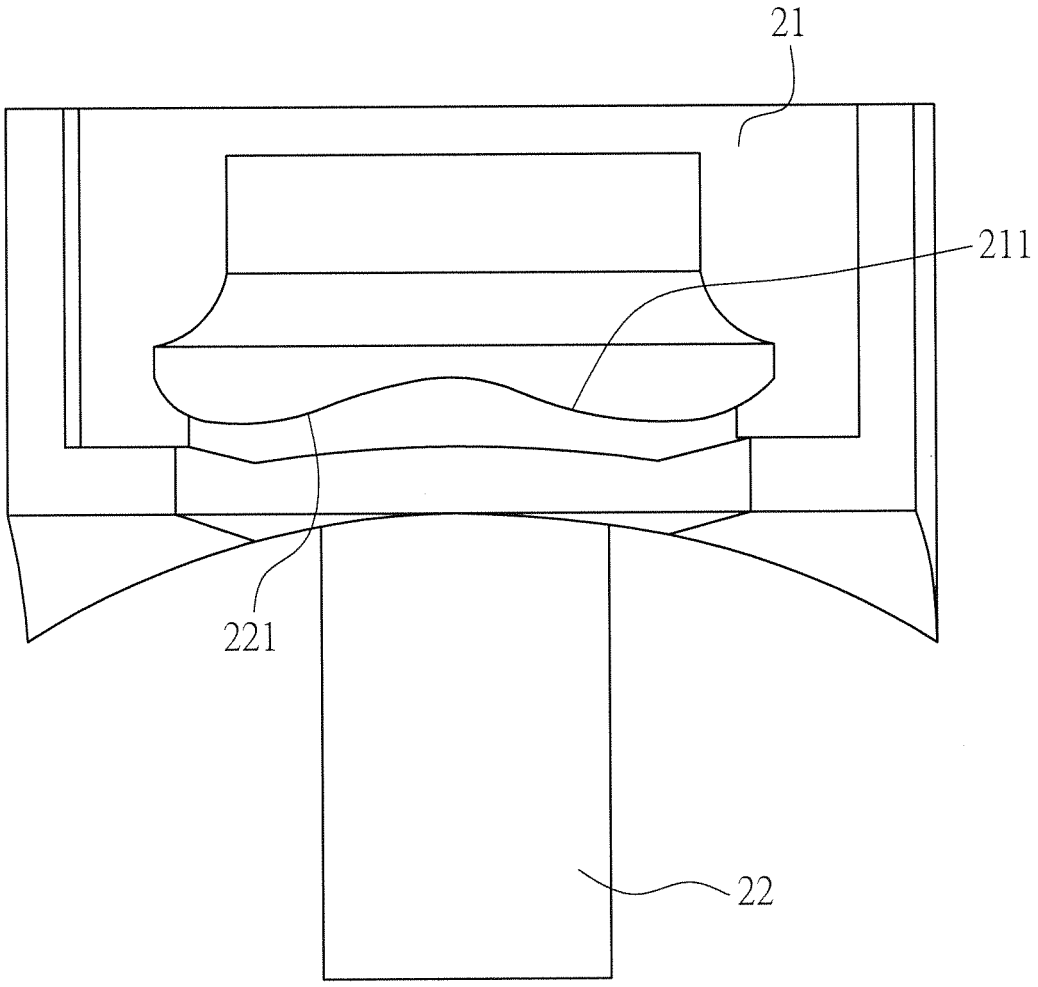
FIG. 5 is a cross-sectional view of the first embodiment for showing the central block abutting against the resettling device.

Referring to FIGS. 4-5, the second uneven surface 211 and the first uneven surface 221 are both undulate. The second uneven surface 211 and the first uneven surface 221 are fitly abutted against each other. Specially, there is no gap between the second uneven surface 211 and the first uneven surface 221 even if the second uneven surface 211 and the first uneven surface 221 are both undulate.

Referring to FIGS. 2-3, the central core 10 is three-dimensional cross-shaped. The central core 10 has a plurality of extruded portions 11. Each extruded portion 11 has a positioning hole 12 axially formed at a tip end thereof. Each resettling device 22 has an insert rod 222. The insert rod 222 is inserted into the positioning hole 12 at a tip portion thereof. The limiting structure for making each resettling device 22 not able to rotate relative to the central core 10 is that the positioning hole 12 is not completely circular. In this embodiment, the positioning hole 12 has an abutting portion 121. A cross-section of the tip portion of the insert rod 222 has the same shape as the positioning hole 12. Clearly, the tip portion of the insert rod 222 has an abutted portion 223. When the insert rod 222 is inserted into the positioning hole 12 at the tip portion thereof, the abutting portion 121 abuts against the corresponding abutted portion 223 so as to make each resettling device 22 not able to rotate relative to the central core 10.

Referring to FIG. 2, each central block 21 has a through opening 212. The second uneven surface 211 is formed in the through opening 212. The second uneven surface 211 is abutted against the first uneven surface 221 of each corresponding resettling device 22 in the through opening 212. A cover 25 is assembled on each central block 21 so as to cover the through opening 212.

Each resettling device 22 passes through each corresponding central block 21, and the first uneven surface 221 abuts against the second uneven surface 211 of each corresponding central block 21. Each resettling device 22 is not able to rotate relative to the central core 10 via the limiting structure. The elastomer 24 is mounted around the assembling member 23 which is locked on the central core 10. Clearly, the assembling member 23 is screwed into a threaded hole 13 of the central core 10. Therefore, each resettling device 22 cannot rotate relative to the central core 10, but can only axially move relative to the central core 10. When one resettling device 22 is moved relative to the central core 10, the recovery force of the corresponding elastomer 24 is increased or decreased, when the corresponding central block 21 is rotated and axially moved relative to the central core 10.

Figure 6:
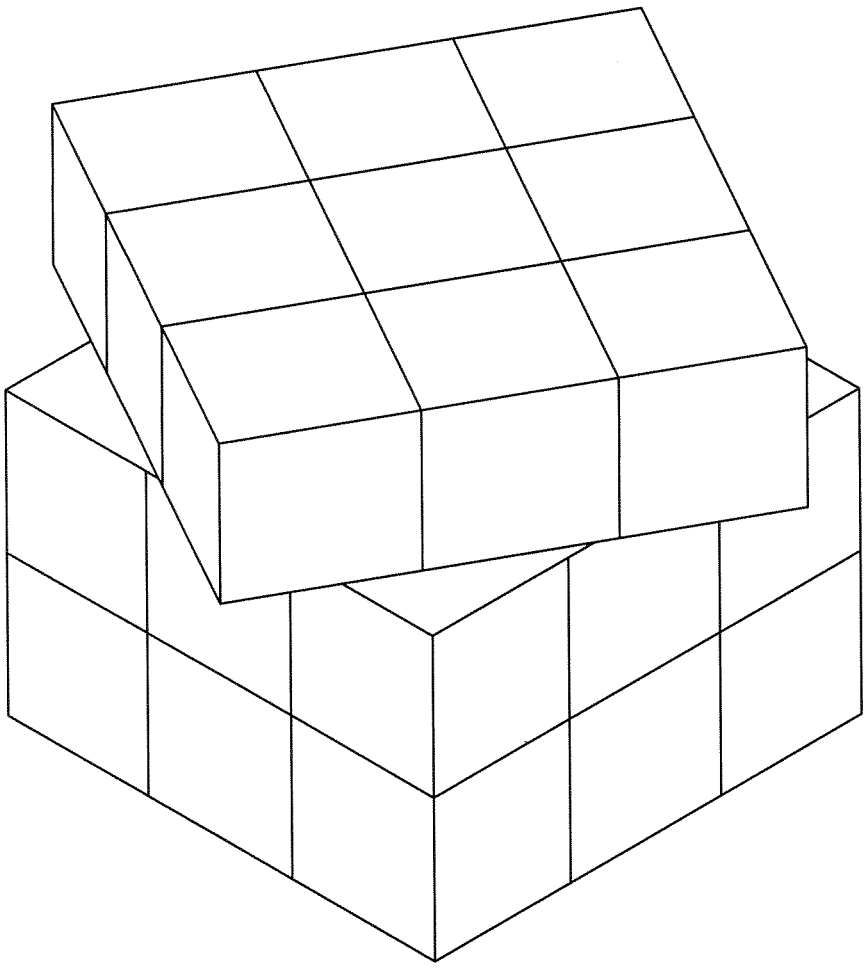
FIG. 6 is a perspective view of the first embodiment for showing one central block rotating certain degrees.
Figure 7:
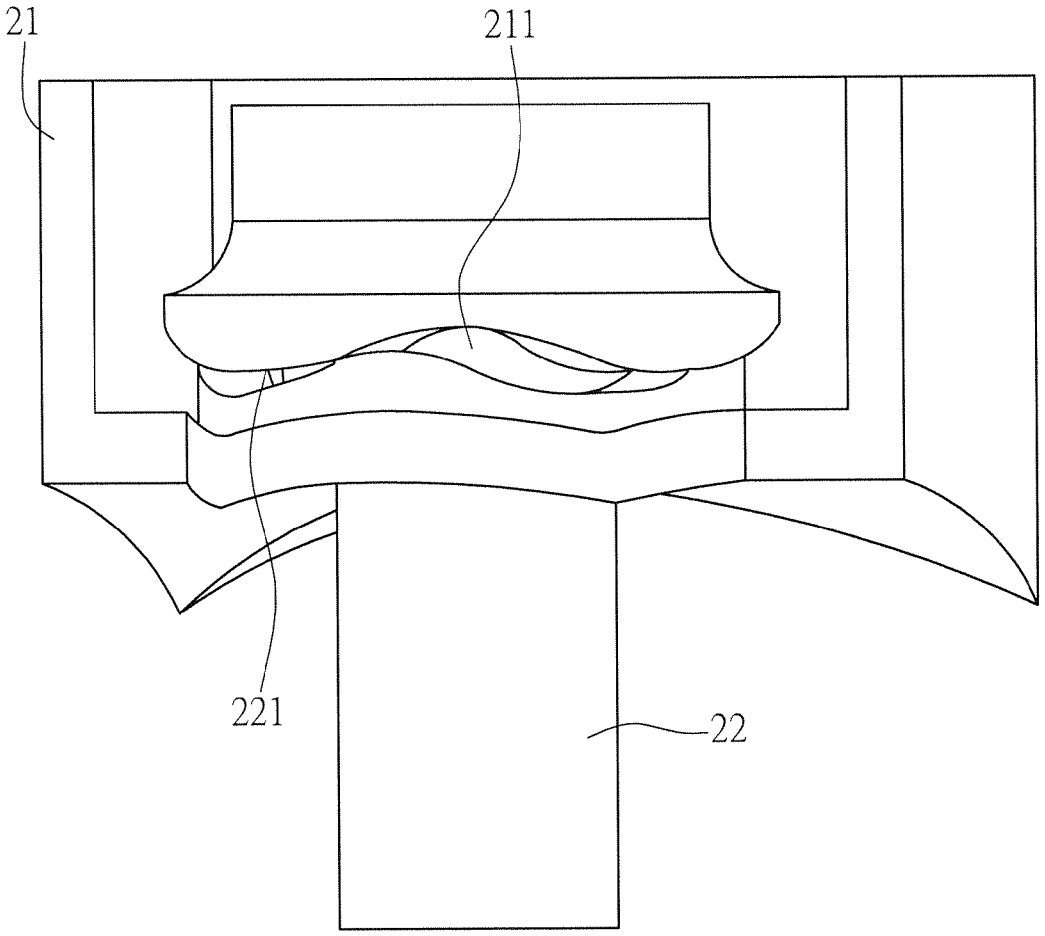
FIG. 7 is a cross-sectional view of the first embodiment for showing the central block pressing the resettling device.

Referring to FIGS. 6-7, when the corresponding central block 21 is rotated certain degree, the second uneven surface 211 thereof is abutted against the first uneven surface 221 of the resettling device 22, and the first uneven surface 221 and the second uneven surface 211 are moved away from each other so as to define a certain distance therebetween (as shown in FIG. 7). Therefore, each resettling device 22 is axially movable. When one resettling device 22 is axially moved from the central core 10, the recovery force of the corresponding elastomer 24 is increased because the corresponding elastomer 24 is compressed.

Figure 8A:
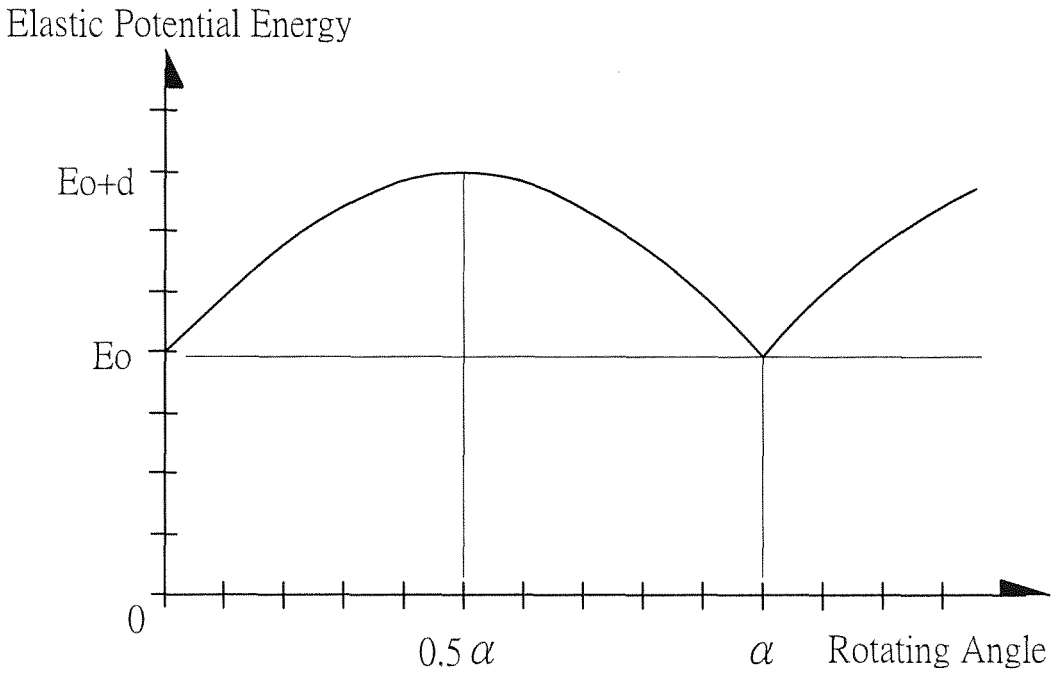
FIG. 8*a* is a functional graph of the first embodiment for showing the recovery force of an elastomer.

Referring to FIG. 8*a*, when the rotation degree is zero or a, the recovery force of the corresponding elastomer 24 would be a certain value (E0) which is minimum, at which the whole structure of the embodiment would be steady. When the corresponding central block 21 is rotated from zero degree toward $0.5\alpha$ degree, the recovery force of the corresponding elastomer 24 would be increased as a certain ascending function. Clearly, the slope of the function curve would be decreased until the slope degree is zero at which the rotation degree is $0.5\alpha$. When the rotation degree is $0.5\alpha$, the recovery force of the corresponding elastomer 24 would be a further certain value which is maximum (E0+d), at which the whole structure of the embodiment would be unsteady. Thereafter, if the corresponding central block 21 is continuously rotated from 0.5α degree toward α degree, the recovery force of the corresponding elastomer 24 would be decreased as a further certain descending function. Clearly, the slope of the function curve would be decreased until the slope degree is the largest at which the rotation degree is α. When the rotation degree is α, the recovery force of the corresponding elastomer 24 would be the certain value (E0) which is minimum, at which the whole structure of the embodiment would be steady once again.

Figure 8B:
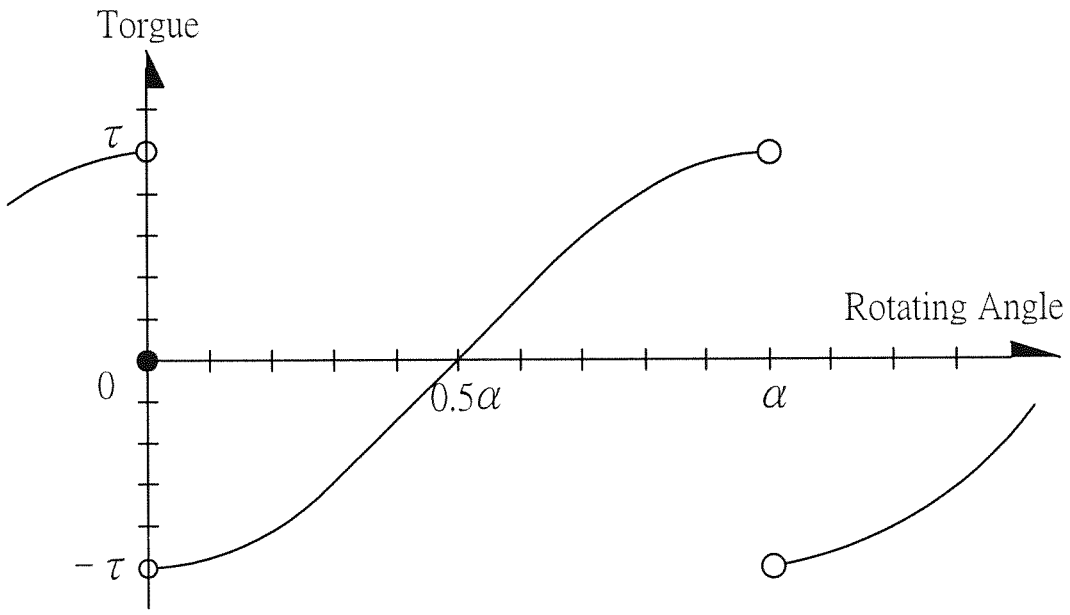
FIG. 8*b* is a functional graph of the first embodiment for showing the torque of the elastomer.

Referring to FIG. 8*b*, when the rotation degree is zero or a, the torque imposed on the central block 21 would be zero. When the corresponding central block 21 starts rotating, the torque would be defined as a certain value (−τ). Thereafter, the torque would be increased with the rotation. When the rotation degree is 0.5α, the torque would be zero once more. Thereafter, if the corresponding central block 21 is continuously rotated from 0.5α degree toward α degree, the torque would be changed from negative state into positive state. Clearly, the positive torque pushes the rotation until the corresponding central block 21 is rotated α degree. If there is no friction, the positive torque pushes the rotation to finish. Specially, if the user unexpectedly rotates the central block 21 between zero and 0.5α degree, the negative torque would rotate the central block 21 back to the original position. Therefore, the user would not worry about the unexpected rotation.

Therefore, the structure of the central block of the present invention is different from that of the conventional magic cube structure. Clearly, the central block 21 and the corresponding resettling device 22 are separated from each other. And both have uneven surfaces which are abutted against each other. When one uneven surface pushes the other, the recovery force of the elastomer would be changed.

Clearly, when the central block is rotated from zero to a degree (for a Rubik's Cube, α is defined as ninety), certain force for the user would be changed. Clearly, when the central block is rotated from zero to 0.5α degree, the certain force for the user is a resistance force (such as friction force and elastic force) which resists the rotation by the user. The recovery force of the corresponding elastomer would be increased as a certain ascending function. Thereafter, when the central block is rotated from 0.5α degree to α degree, the recovery force of the corresponding elastomer pushes the rotation to finish, at which the recovery force of the corresponding elastomer would be decreased as the further certain descending function. If the central block is rotated integral multiple of α degree, the recovery force of the corresponding elastomer would be the certain value (E0) which is minimum, at which the whole structure of the embodiment would be steady.

Figure 9A:
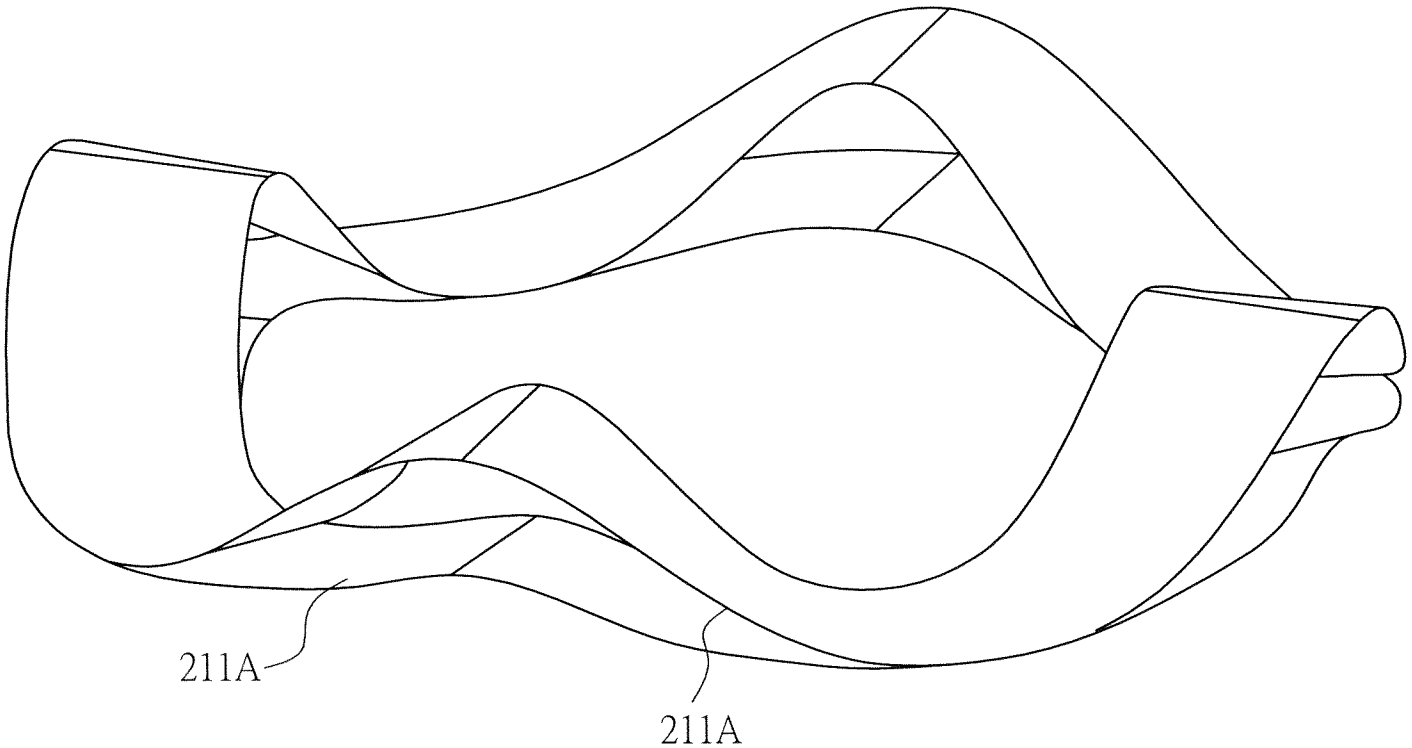
FIG. 9*a* is a perspective view of a second embodiment for showing the central block and the resettling device.
Figure 9B:
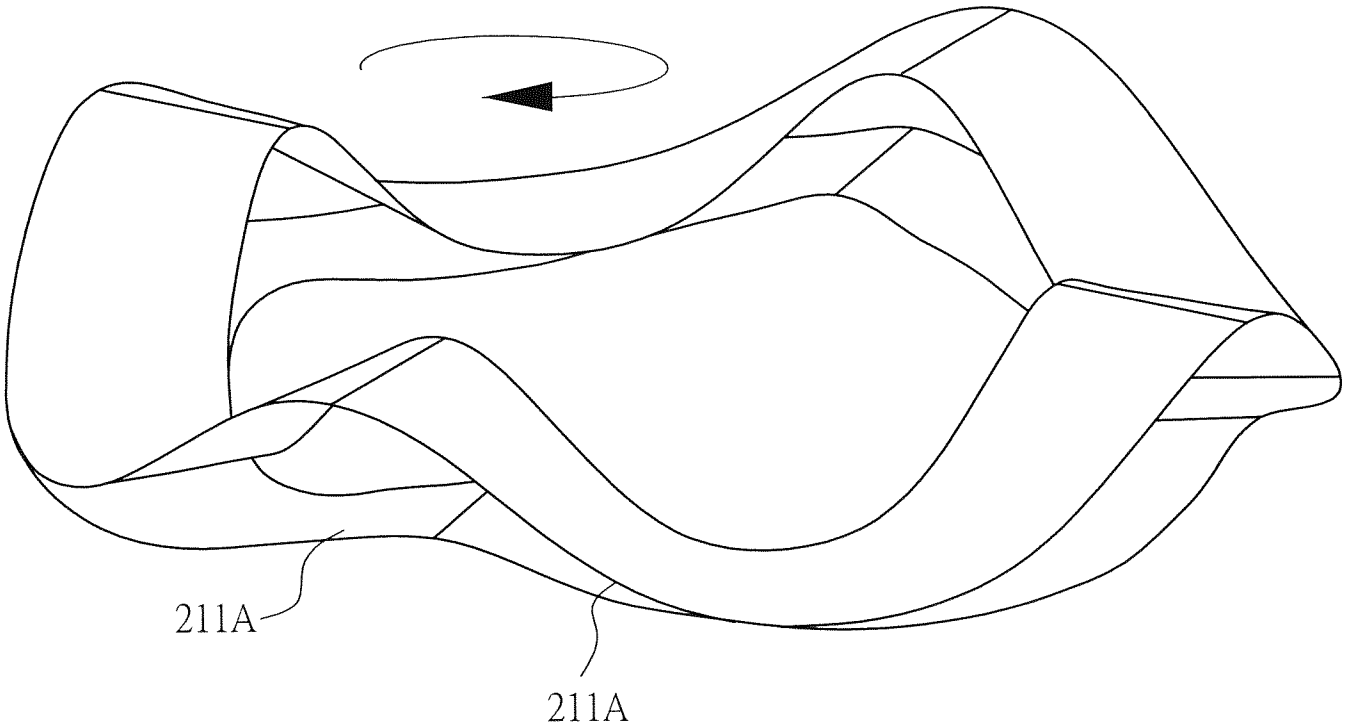
FIG. 9*b* is a perspective view of the second embodiment for showing the central block pressing against the resettling device.
Figure 10A:
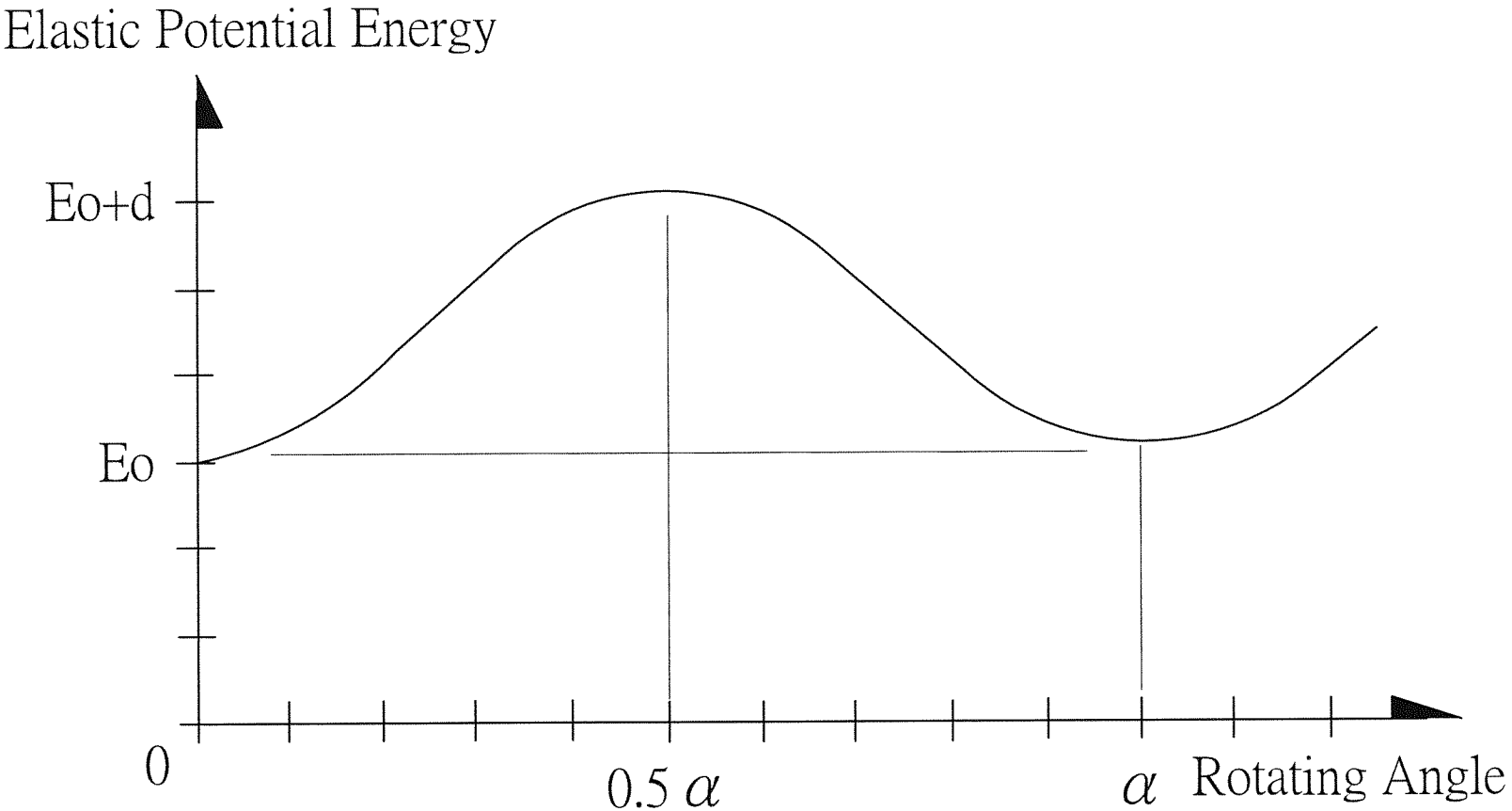
FIG. 10*a* is a functional graph of the second embodiment for showing the recovery force of an elastomer.
Figure 10B:
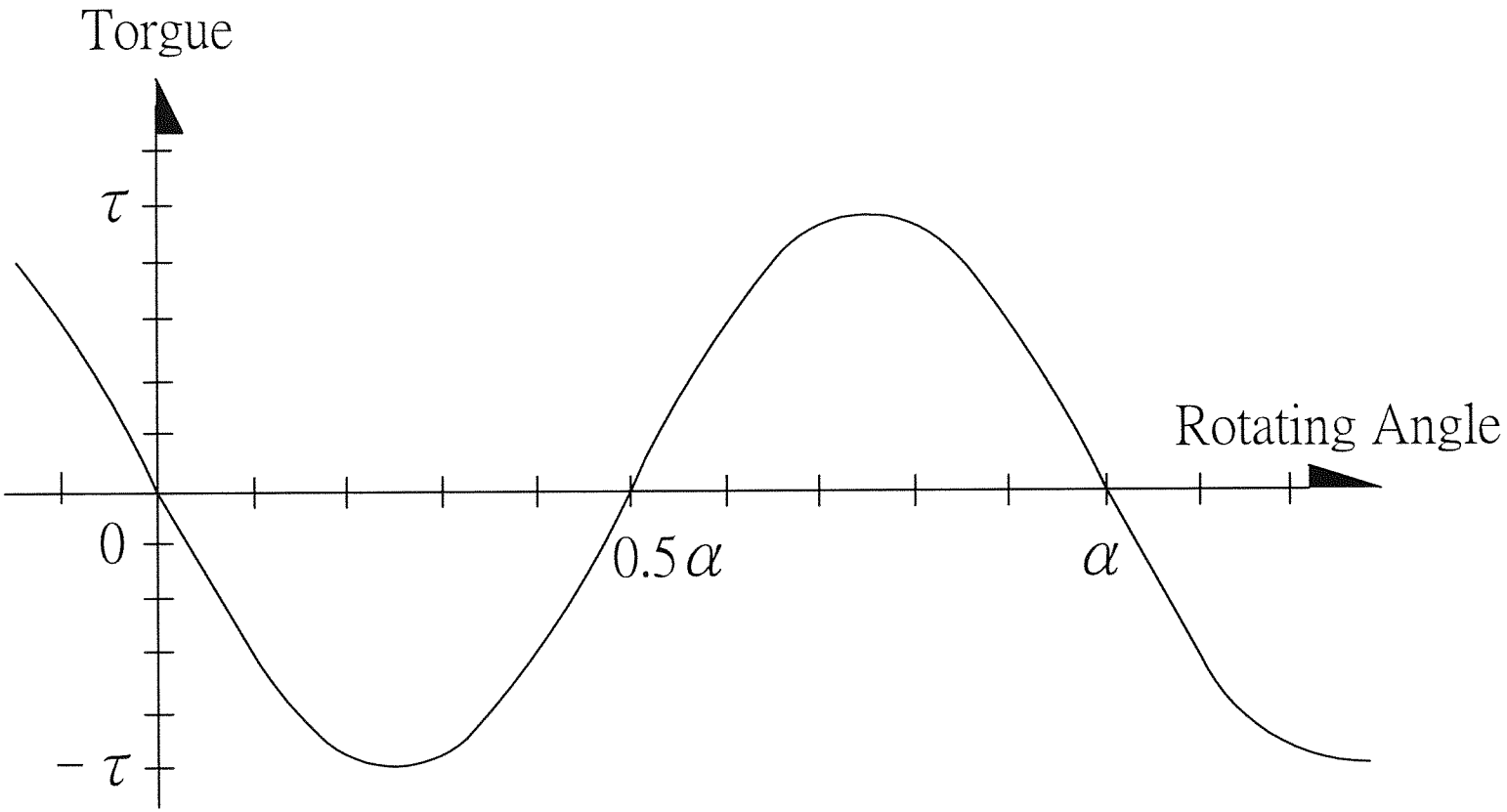
FIG. 10*b* is a functional graph of the second embodiment for showing the torque of the elastomer.

Referring to FIGS. 9*a*-10*b*, a second embodiment in accordance with a magic cube structure of the present invention is described as follows (only the difference between the first and second embodiments would be described herein). A first uneven surface 221A abuts against a second uneven surface 211A but not fitly. In other words, a gap is defined therebetween (as shown in FIG. 9*a*). When the second uneven surface 211A is rotated (as shown in FIG. 9*b*), a difference between the first (as shown in FIG. 8*a*) and second embodiments is described as follows. Referring to FIG. 10*a*, when the rotation degree is zero or α, the slop degree of the function curve is zero so that another function curve shown in FIG. 10*b* is continuous. Therefore, when the rotation degree is close to nα (n is s certain integer), the state is steadier than the first embodiment, but the recovery force is smaller than the first embodiment.

Figure 11:
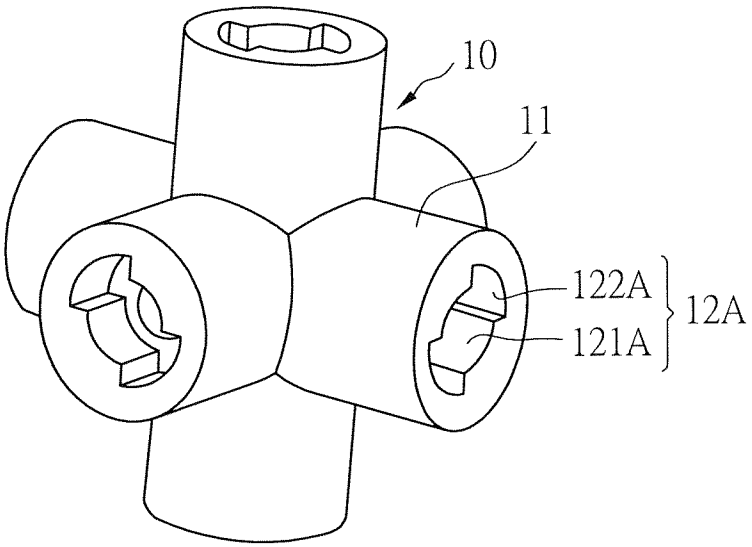
FIG. 11 is a perspective view of a third embodiment for showing the central core and the resettling device.
Figure 11:
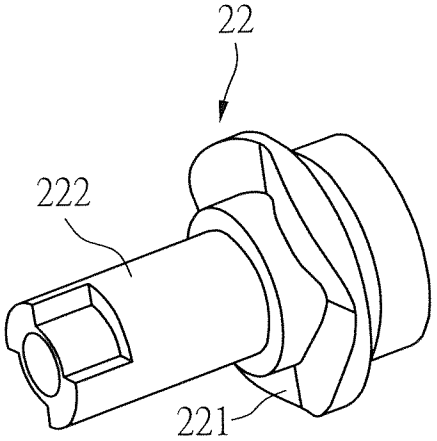

Referring to FIG. 11, a third embodiment in accordance with a magic cube structure of the present invention is described as follows (only the difference between the first and third embodiments would be described herein). Each extruded portion 11 has a positioning hole 12A axially formed at a tip end thereof. The positioning hole 12A has a central portion 121A and two lateral portions 122A. The insert rod 222 of each resettling device 22 is inserted into the positioning hole 12A at a tip portion thereof. The shape of the insert rod 222 corresponds to the positioning hole 12A. However, these components should not limit the present invention; in other words, any type of the limiting structure should be in the claimed scope. Each resettling device 22 is not able to rotate relative to the central core 10, but is axially movable relative to the central core 10. Therefore, each resettling device 22 is a movable part. The relationship between the insert rod and the positioning hole makes each resettling device 22 not able to rotate relative to the central core 10.

Figure 12:
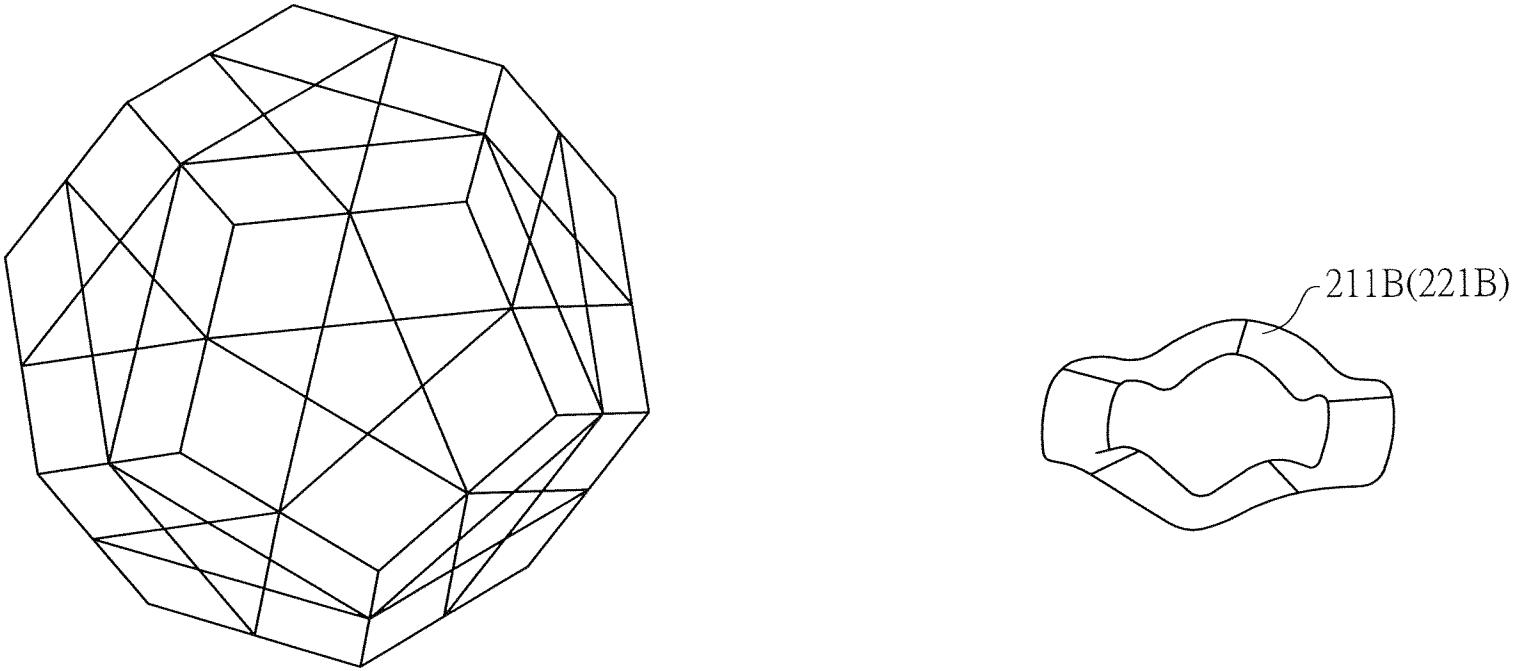
FIG. 12 is a perspective view of a Magic Dodecahedron.
Figure 13:
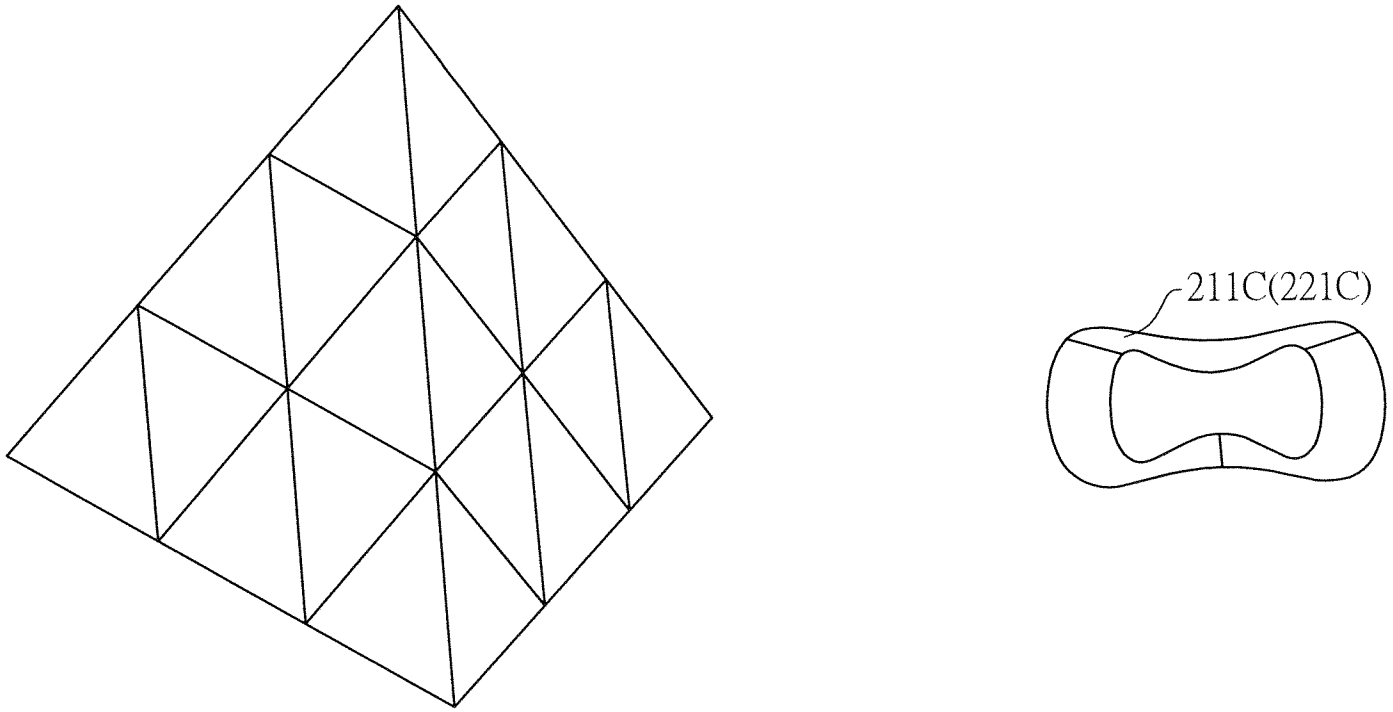
FIG. 13 is a perspective view of a Pyraminx Cube.
Figure 14:
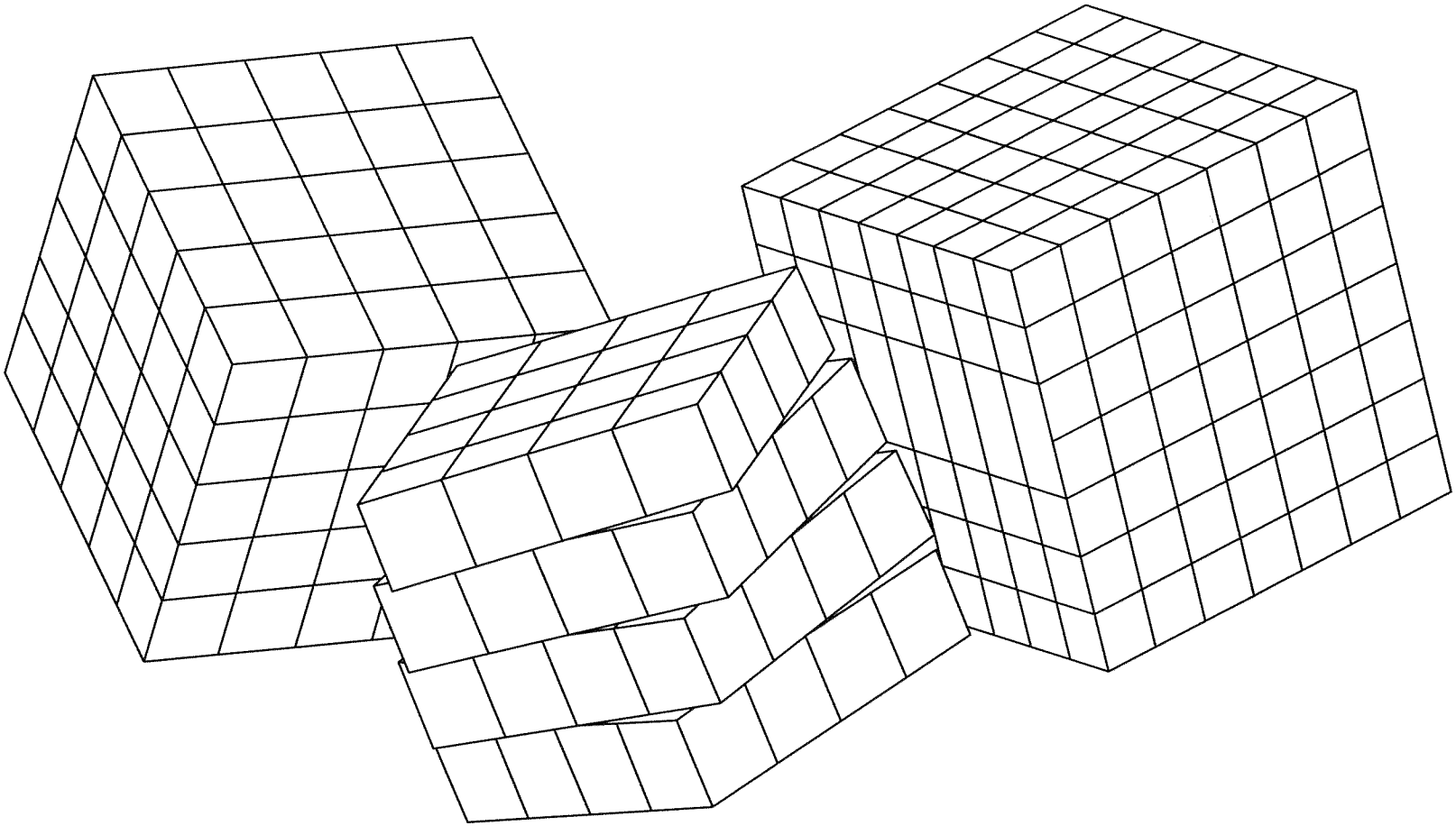
FIG. 14 is a perspective view of a regular hexahedron cube.

Each of said embodiments is illustrated as Rubik's Cube. However, this should not limit the present invention. In other words, another embodiment of the present invention could be illustrated another type such as Magic Dodecahedron (as shown in FIG. 12). Referring to FIG. 12, each of a first uneven surface 221B and a second uneven surface 211B has five concave portions and five convex portions. The concave portions and the convex portions are alternate. In this embodiment, the a is defined as seventy two. Referring to FIG. 13, another embodiment of the present invention is illustrated as Pyraminx Cube. Each of a first uneven surface 221C and a second uneven surface 211C has three concave portions and three convex portions. In this embodiment, the α is defined as 120. Referring to FIG. 14, another few embodiments of the present invention are illustrated as regular hexahedron cubes. The α is defined as ninety.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A magic cube structure comprising:

a central core, a plurality of central blocks, a plurality of resettling devices, a plurality of elastomers, a plurality of side blocks and a plurality of corner blocks, an assembling member assembling each resettling device on the central core, each resettling device connecting each corresponding central block and the central core, a limiting structure for making each resettling device not able to rotate relative to the central core, each elastomer pushing each corresponding resettling device toward the central core, wherein, each resettling device has a first uneven surface, the first uneven surface abutting against each corresponding central block, when each elastomer pushes each corresponding resettling device toward the central core, each central block having a second uneven surface, the second uneven surface abutted against the first uneven surface of each corresponding resettling device, the second uneven surface and the first uneven surface fitly abutted against each other, via a recovery force of each corresponding elastomer;

whereby, when one central block is rotated relative to the central core by an outer force, the second uneven surface is pressed by the first uneven surface of the corresponding resettling device and is axially moved away therefrom; simultaneously, the recovery force of the corresponding elastomer is increased, so that a torque imposed on the central block is created; when the rotation operation is completed, the torque makes the second uneven surface fitly abutted against the corresponding first uneven surface once again; as a result, the recovery force returns to former state.

2. The magic cube structure as claimed in claim 1, wherein the second uneven surface and the first uneven surface are both undulate; when the second uneven surface and the first uneven surface are fitly abutted against each other, there is no gap between the second uneven surface and the first uneven surface.

3. The magic cube structure as claimed in claim 1, wherein the second uneven surface and the first uneven surface are both undulate; when the second uneven surface and the first uneven surface are abutted against each other, an abutting state is not fitly and a gap is defined therebetween.

4. The magic cube structure as claimed in claim 1, wherein the central core is three-dimensional cross-shaped and has a plurality of extruded portions; each extruded portion has a positioning hole axially formed at a tip end thereof; each resettling device has an insert rod inserted into the positioning hole at a tip portion thereof; the limiting structure for making each resettling device not able to rotate relative to the central core is that the positioning hole is not completely circular.

5. The magic cube structure as claimed in claim 1, wherein each central block has a through opening; the second uneven surface is abutted against the first uneven surface of each corresponding resettling device in the through opening; a cover is assembled on each central block so as to cover the through opening.

6. The magic cube structure as claimed in claim 5, wherein the assembling member is illustrated as one selected form a group consisting of a screw, a rivet and a nut.

7. The magic cube structure as claimed in claim 6, wherein each elastomer is illustrated as a spring which is mounted around the assembling member.

* * * * *